US008464689B2

(12) United States Patent
Born et al.

(10) Patent No.: US 8,464,689 B2
(45) Date of Patent: Jun. 18, 2013

(54) THROTTLE BODY TO INTAKE MANIFOLD MOUNTING

(75) Inventors: David Born, Commerce Township, MI (US); Jeremy Walter Church, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 471 days.

(21) Appl. No.: 12/882,329

(22) Filed: Sep. 15, 2010

(65) Prior Publication Data

US 2012/0060794 A1 Mar. 15, 2012

(51) Int. Cl.
*F02D 9/10* (2006.01)

(52) U.S. Cl.
USPC ..... 123/337; 251/305; 251/148

(58) Field of Classification Search
USPC ..... 123/336, 337; 251/148, 367
See application file for complete search history.

(56) References Cited

U.S. PATENT DOCUMENTS

| | | | | |
|---|---|---|---|---|
| 5,875,758 | A * | 3/1999 | Fujita | 123/336 |
| 5,970,963 | A | 10/1999 | Nakase et al. | |
| 7,055,499 | B1 | 6/2006 | Kuwano et al. | |
| 7,137,378 | B1 | 11/2006 | Jaeger et al. | |
| 2006/0169247 | A1 | 8/2006 | Vichinsky | |
| 2008/0313898 | A1 | 12/2008 | Kim | |

FOREIGN PATENT DOCUMENTS

JP 411037001 A * 2/1999

* cited by examiner

*Primary Examiner* — Erick Solis

(57) ABSTRACT

At least one set of locator pins is provided on the flange of an intake manifold which couple with an orifice provided on the flange of a throttle body to align the two parts to ensure that they are properly oriented when assembled. In addition, through holes are provided on the throttle body flange and threaded inserts are provided on the flange of the intake manifold. The locator pins are coupled with the orifices prior to inserting a bolt through the through holes to engage with the threads of the threaded insert. By providing the locator pins, the two flanges are held in a desired orientation so that the ducts of the two flanges are properly aligned to substantially eliminate a step or mismatch at the interface.

12 Claims, 2 Drawing Sheets

THROTTLE BODY TO INTAKE MANIFOLD MOUNTING

BACKGROUND

1. Technical Field

The present disclosure relates to coupling a throttle body with an intake manifold.

2. Background Art

Automotive throttle bodies have a flange for coupling with a flange located on an inlet side of an intake manifold. Typically the throttle body is metallic, possibly of aluminum, with a metallic throttle plate pivoting inside. Modern intake manifolds are injection molded of a polymeric material. The coupling between the two are shown in FIG. 1. A cross-section of a portion of throttle body 10 is shown in FIG. 1. The throttle body has a throttle plate 11 that rotates about rod 13. Throttle plate 11 may be mechanically actuated by the operator of the vehicle. More commonly found recently, is an electronically actuated throttle plate that is actuated by a stepper motor (not shown) or other suitable motor. Throttle plate 11 includes a flange 14 that couples with a flange 16 of an intake manifold (a portion of a cross-section of which is also shown in FIG. 1). Unthreaded through holes 18 are provided on flange 14. At least three through holes are provided in flange 14. However, the cross-section represented in FIG. 1 is taken through only two through holes 18. Flange 16 of intake manifold 12 includes threaded inserts 20. Although not shown in FIG. 1, a bolt is provided for each pair of through hole 18 and threaded insert 20 and is inserted in the direction of arrow 22.

To allow for coupling of the two parts in spite of manufacturing tolerances and to allow the bolts to be easily inserted, through holes 18 are slightly oversized. The inside diameters of throttle body 10 and intake manifold 12 may be offset slightly due to the slight oversize of the inside diameters of throttle body 10 and other manufacturing tolerances. The mismatch is shown in FIG. 1 as "m." As flow travels from throttle body 10 into intake manifold 12, the mismatch on the top side of the joint is called a rearward facing step and the mismatch on the lower side of the joint is a forward facing step. The mismatch leads to eddies being formed and leads to a whistling sound that is noticeable to the operator of the vehicle. Such a mismatch also slightly negatively impacts the maximum amount of flow to the engine, i.e., slightly hurting peak engine performance. The mismatch shown in FIG. 1 is particularly troublesome because it is located proximate the flow when throttle valve 11 is partially open. That is the substantially round throttle plate and the substantially round duct of throttle body 12, seal around the periphery when throttle valve 11 is in a vertical position. As throttle valve 11 is partially opened, flow rushes through the crescent-shaped openings at uncovered by throttle valve 11. Thus, a mismatch occurring in the vicinity of where the majority of the flow enters is particularly troublesome.

SUMMARY

According to an embodiment of the disclosure at least two sets of locator pins are provided on the flange of the intake manifold which couple with orifices provided on the flange of the throttle body. In addition, through holes are provided on the throttle body flange and threaded inserts are provided on the flange of the intake manifold. The locator pins are coupled with the orifices prior to inserting a bolt through the through holes to engage with the threads of the threaded insert. By providing the locator pins, the two flanges are held in a desired orientation so that the ducts of the two flanges are properly aligned to substantially eliminate a step at the interface.

In one embodiment, a throttle body-to-manifold coupling system has a first flange coupled to the throttle body, a second flange coupled to the manifold, a set of locator pins extending outwardly from the second flange, and an orifice provided on the first flange for the set of locator pins. The set of locator pins and the associated orifice are arranged to couple when the manifold is assembled to the throttle body. An inside diameter of the first flange is substantially equal to an inside diameter of the second flange. The second flange further comprises at least three threaded inserts arranged on the periphery of the second flange. The first flange has a through hole associated with each of the at least three threaded inserts. A bolt associated with each of the at least three threaded inserts is inserted through the through hole and engaged with threads on the threaded insert. The locator pins extend outwardly from the second flange approximately perpendicular to a face of the second flange. A cross section of each set of locator pins in a plane parallel to a face of the flange is contained within a cylinder having a diameter substantially equal to a diameter of the orifice. The intake manifold, the flange of the intake manifold, and the locator pins are comprised of a polymeric, elastic material. In one embodiment, the set of locator pins is arranged on the flange along an axis roughly perpendicular to the axis of the pin associated with the throttle valve. This location locates the intake manifold with respect to the throttle body in the area in which a mismatch or step is more problematic. In other embodiments, two or more sets of locator pins with associated orifices are provided. In such an embodiment, the sets of locator pins may be place around the flange asymmetrically to prevent misassembly.

The first flange defines a central opening and the sets of locator pins are asymmetrically arranged on a periphery of the second flange with respect to the opening. The first flange has a roughly centrally-located first opening of a particular diameter; the second flange has a roughly centrally-located second opening of the particular diameter; and the first and second openings are substantially aligned when the locator pins and the associated orifices are coupled. Each set of locator pins comprises at least two locator pins. In one embodiment, the cross-sectional area of the locator pins is roughly constant along their length except at a distal end of the locator pins that has a slight chamfer with the chamfer located away from the other pins of a set of locator pins. In an alternative embodiment, the pins are tapered with the cross-sectional area of the pins being larger proximate the flange.

By using a set of locator pins of an elastic material, the pins can flex to facilitate the alignment and coupling of the pins with the orifices. Also, the chamfers assist in the alignment. As the locator pins are fully engaged with the orifices, however, the pins provide little or no flexibility in alignment and force the throttle body into proper alignment with the intake manifold. Such a system provides an advantage over coupling systems relying solely on the through holes in the throttle body for alignment.

Also disclosed is a method to couple a throttle body to an intake manifold, including aligning a set or sets of locator pins that extend outwardly from a flange on the intake manifold with orifices defined in a flange on the throttle body; engaging the locator pins with the orifice(s); inserting bolts into through holes in flanges associated with the throttle body; engaging threads on the outside surface of the bolts with the threads on the inside surface of the threaded inserts; and tightening the bolts to provide a desired clamping force between the throttle body and the intake manifold. The sets of locator pins are arranged around the periphery of the flange on the intake manifold possibly asymmetrically arranged. The locator pins extend outwardly from the flange associated with the intake manifold from a face of the flange adapted to couple with the flange on the throttle body with an axis of the locator pins being roughly perpendicular to a surface of the flange on the intake manifold. The cross-sectional area of the locator pins is roughly constant along the length except at a distal end of the locator pins that has a slight chamfer.

Not only do the locator pins align the central openings in the two flanges, but they also aid in the assembly of the intake manifold with the throttle body by holding the two together while the bolts are inserted and tightened.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

Figure 1:
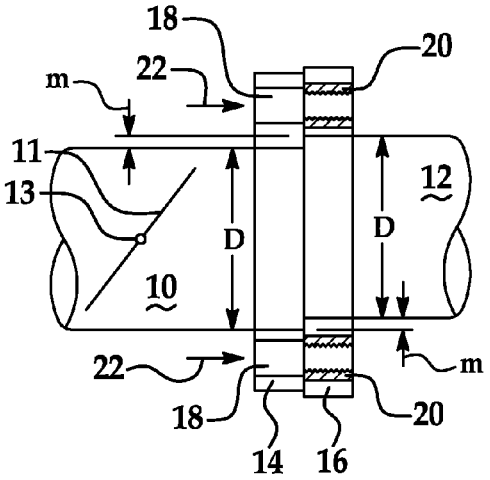
FIG. 1 shows a cross section of a coupling joint of a throttle body and an intake manifold.
Figure 2:
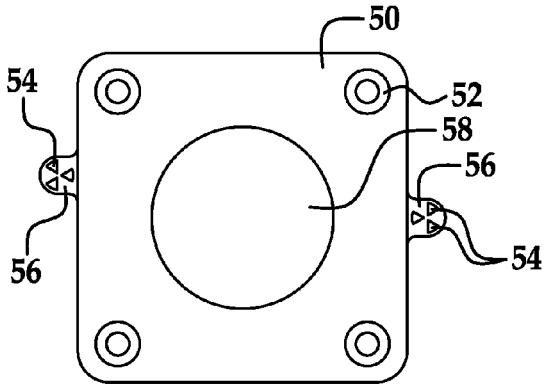
FIG. 2 is an end view of a flange of an intake manifold.

An end view of flange 50 associated with an intake manifold is shown in FIG. 2. Flange 50 has threaded inserts 52 provided at multiple locations around the periphery. Two sets of locator pins 54 extend outwardly from flange 50 with the axial direction of pins 54 being roughly perpendicular to the face of flange 50. There may be any number of sets of locator pins with a minimum of one. In the non-limiting example shown in FIG. 3, the sets of locator pins 54 are associated with tabs 56 that extend perpendicularly from the face flange 50. Each set of locator pins 54 includes three pins; but, in other embodiments, each set includes as few as two pins and as many as four or more. In another embodiment, sets of locator pins 54 are provided on the main portion of the face of flange 50. Flange 50 has an opening 58 of a particular diameter. In other embodiments, the opening may shaped other than round.

In one embodiment, the face of tabs 56 is roughly coincident with the face of flange 50. Alternatively, the face of tabs 56 is recessed with respect to the face of flange 50 and will be discussed further in reference to FIG. 11.

Figure 3:
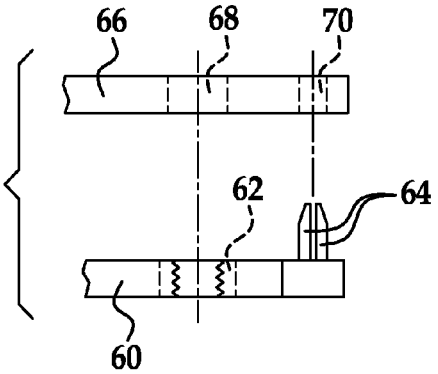
FIG. 3 is a portion of flanges for an intake manifold and a throttle body prior to coupling.

In FIG. 3, a portion of a throttle body flange 66 and a portion of a manifold flange 60 are shown in an unassembled state. Flange 66 has a through hole 68 to align with threaded insert 62 of flange 60. Locator pins 64 extend upwardly from the face of flange 60. An orifice 70 is provided on flange 66.

Figure 4:
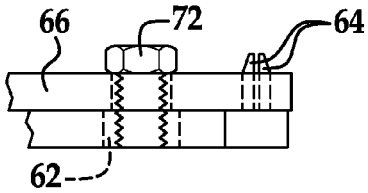
FIG. 4 is a portion of flanges for an intake manifold and a throttle body as coupled.

In FIG. 4, flanges 60 and 66 are shown assembled. A bolt 72 is shown that extends through the through hole 68 and engages with the threads of threaded insert 62. Locator pins 64 extend into orifice 70. As shown in FIG. 4, pins 64 extend through orifice 70. In other embodiments, the pins are shorter and the orifice may not go through the flange.

Figure 5:
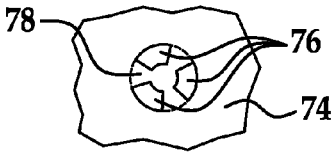
FIGS. 5, 6, and 7 are end views of sets of locator pins.
Figure 6:
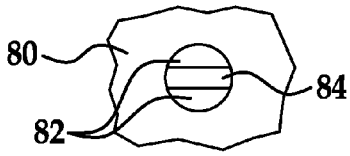
Figure 7:
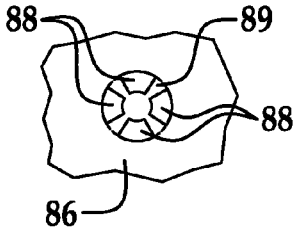

In FIG. 5, three locator pins 76 make up a set on flange 74. In FIG. 6, flange 82 has two locator pins 82 per set. In FIG. 7, each set of locator pins 88 is made up of four pins per set on a flange 86. In FIGS. 5, 6, and 7, the locator pins are contained within a cylinder (not shown) that is a projection from circles 78, 84, and 89, respectively. The diameter of the circle is substantially identical or slightly larger with the orifice with which it is to couple. An example orifice is shown in FIG. 3 as element 70.

Figure 8:
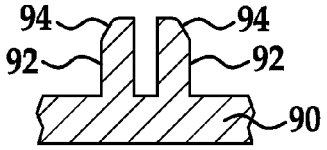
FIG. 8 is a side view of a set of locator pins.

In FIG. 8, a portion of a flange 90 has two pins 92 extending upwardly. Tips of pins 92 have a small chamfer 94. Chamfers 94 cause tips 92 of a set of tips to be within a circle of smaller cross section than the associated orifice. These chamfers 94 may aid in aligning the manifold with the throttle body. When fully assembled, the chamfers of pins 64 clear the orifice in flange 66, as shown in FIG. 5.

Figure 9:
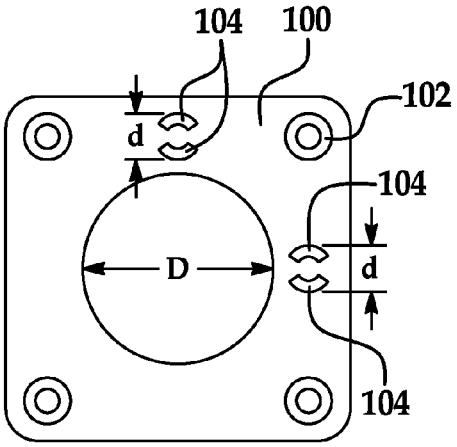
FIG. 9 is an end view of a flange of an intake manifold.

In FIG. 9, the face of a flange 100 of a manifold has four threaded inserts 102, locator pins 104, and an opening of diameter, D. In this example, locator pins 104 are provided in pairs and are contained within a circular region having a diameter, d. The locations of the locator pin sets are placed asymmetrically on flange 100 to prevent the possibility of misaligning with the mating flange.

Figure 10:
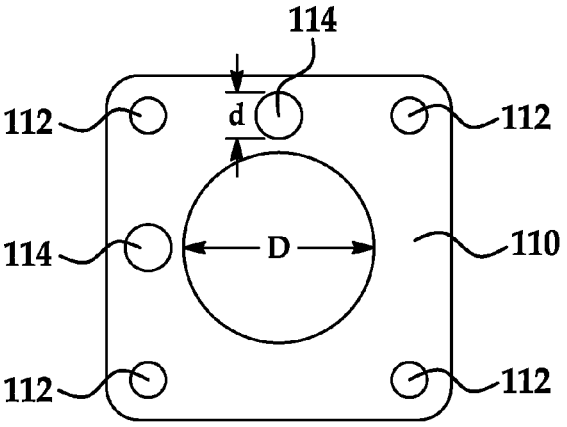
FIG. 10 is an end view of a flange of a throttle body.

In FIG. 10, the face of a flange 110 of a throttle body, i.e., a flange to mate with flange 100 of FIG. 10, is shown having four through holes 112, two orifices 114 having a diameter, d, and an opening having a diameter, D. Orifices 112 are arranged to align with inserts 102 and locator pins 104 are arranged to align with orifices 114 when flange 100 is coupled with flange 110.

Figure 11:
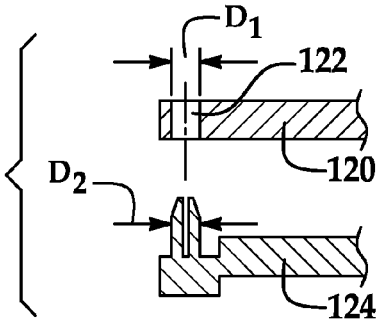
FIG. 11 is across section of uncoupled portion of flanges for an intake manifold and a throttle body.

In one embodiment locator pins are provided on the flange of the intake manifold. In another embodiment, the locator pins are provided on tabs extending outwardly from the normal boundaries of the intake manifold flange. In yet another embodiment, the tabs that extend outwardly from the intake manifold flange are recessed. An example of such a configuration is shown in FIG. 11 in which a cross section of a portion of a throttle body flange 120 has a through hole 22 of diameter, D1. A cross section of a portion of an intake manifold flange 124 has a recessed tab 126 extending outwardly. At least two locator pins 128 extend upwardly from tab 124 have an effective outer diameter, D2, slightly larger than D1. As pins 128 have a slight chamber at their tips, i.e., the distal portion of pins 128, they engage with through hole 122 of flange 120 upon assembly. Pins 128 displace towards each other to allow them to travel into through hole 122. In an embodiment with two locator pins, the width of the locator pins in the direction of the gap between the two pins is less than or equal to D1 to allow coupling with through hole 122.

While the best mode has been described in detail, those familiar with the art will recognize various alternative designs and embodiments within the scope of the following claims.

Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. A throttle body-to-manifold coupling system, comprising:

a first flange coupled to the throttle body;

a second flange coupled to the manifold;

sets of locator pins extending outwardly from the second flange; and an orifice provided on the first flange for each set of locator pins wherein each set of locator pins and the associated orifice are arranged to couple when the manifold is assembled to the throttle body; and wherein the first flange has the sets of locator pins extending perpendicularly from a face of the first flange, the first flange defines a roughly central opening, and the sets of locator pins are asymmetrically arranged on a periphery of the second flange with respect to the opening.

2. The coupling system of claim 1 wherein the first flange has a roughly centrally-located first opening of a particular diameter; the second flange has a roughly centrally-located second opening of the particular diameter; and the first and second openings are substantially aligned when the locator pins and the associated orifices are coupled.

3. The coupling system of claim 1 wherein each set of locator pins comprises at least two locator pins.

4. The coupling system of claim 1 wherein the cross-sectional area of the locator pins is roughly constant along their length except at a distal end of the locator pins that has a slight chamfer with the chamfer located away from the other pins of a set of locator pins.

5. A method to couple a throttle body to an intake manifold, comprising:

aligning at least one set of locator pins that extend outwardly from a flange on the intake manifold with at least one orifice defined in a flange on the throttle body; and engaging the locator pins with the orifices; and wherein the sets of locator pins are arranged around the periphery of the flange on the intake manifold in an asymmetrical fashion.

6. The method of claim 5 wherein the intake manifold has threaded inserts mounted in the flange of the intake manifold, the method further comprising:

inserting bolts into through holes in flanges associated with the throttle body;

engaging threads on the outside surface of the bolts with the threads on the inside surface of the threaded inserts; and tightening the bolts to provide a desired clamping force between the throttle body and the intake manifold.

7. The method of claim 5 wherein each set of locator pins comprises at least two pins.

8. The method of claim 5 wherein the locator pins extend outwardly from the flange associated with the intake manifold from a face of the flange adapted to couple with the flange on the throttle body with an axis of the locator pins being roughly perpendicular to a surface of the flange on the intake manifold.

9. The method of claim 5 wherein the locator pins taper such that a cross-sectional area of the pins proximate the flange is greater than a cross-section area of tips of the pins.

10. A coupling system, comprising:

a throttle body including a flange having at least three through holes and at least one orifice;

an intake manifold including a flange having at least three threaded inserts adapted to couple with the at least three through holes of the throttle body and at least one set of locator pins adapted to couple with the at least one orifice; and at least three bolts adapted to engage with the at least three threaded inserts; and wherein at least one tab extends outwardly from the flange of the intake manifold and one set of locator pins extends upwardly from the at least one tab.

11. The coupling system of claim 10 wherein a face of the at least one tab is recessed with respect to a face of the flange of the intake manifold and an effective diameter of the one set of locator pins is greater than a diameter of the through hole.

12. The coupling system of claim 10 wherein a face of the at least one tab is substantially coincident with a face of the flange of the intake manifold and an effective diameter of the one set of locator pins is substantially equal to a diameter of the through hole.

* * * * *